US005748205A

United States Patent [19]

Duperrier

[11] Patent Number: 5,748,205

[45] Date of Patent: May 5, 1998

[54] INKJET PRINTER

[75] Inventor: Marc Duperrier, Fiez, Switzerland

[73] Assignee: OCD S.A., Yverdon, Switzerland

[21] Appl. No.: 600,371

[22] Filed: Feb. 13, 1996

[30] Foreign Application Priority Data

Feb. 22, 1995 [CH] Switzerland ..... 513/95

[51] Int. Cl.[6] ..... B41J 2/165

[52] U.S. Cl. ..... 347/29

[58] Field of Search ..... 347/20, 22, 29, 347/33

[56] References Cited

U.S. PATENT DOCUMENTS

| | | | |
|---|---|---|---|
| 4,908,638 | 3/1990 | Albosta et al. | 347/43 |
| 5,051,761 | 9/1991 | Fisher | 347/30 |
| 5,155,497 | 10/1992 | Martin et al. | 347/33 |
| 5,424,768 | 6/1995 | Dudek et al. | 347/29 |
| 5,432,539 | 7/1995 | Anderson | 347/33 |
| 5,548,310 | 8/1996 | Binnert et al. | 347/33 |
| 5,585,826 | 12/1996 | Schroeder | 347/29 |
| 5,602,573 | 2/1997 | Waschhauser et al. | 347/33 |
| 5,621,441 | 4/1997 | Waschhauser et al. | 347/33 |
| 5,644,346 | 7/1997 | Schwiebert et al. | 347/33 |
| 5,644,347 | 7/1997 | Schwiebert et al. | 347/33 |

FOREIGN PATENT DOCUMENTS

| | | |
|---|---|---|
| 0 653 306 | 5/1995 | European Pat. Off. . |
| 0 674 996 | 10/1995 | European Pat. Off. . |

*Primary Examiner*—Adolf Berhane
*Attorney, Agent, or Firm*—Young & Thompson

[57] ABSTRACT

The printer has a frame (7), a movable carriage (1) on which can be plugged in at least two types of printing heads (2) and a maintenance station (6). This latter comprises a plate support (16) on which is secured at least two covers arranged in a direction perpendicular to the translation of the carriage (1). The plate support (16) is connected by a first pair of flat springs (17) to an intermediate plate (18) which is itself connected by a second pair of flat springs (19) to the frame (17) of the printer. This arrangement permits, with a single support driven by the advance of the carriage, effecting on the one hand the selection movement of the cover (2) to be applied and on the other hand the application movement of the selected cover against the plugged-in printer head. There is thus provided a very simple construction, with a low cost of production and operation.

7 Claims, 6 Drawing Sheets

Figure 1:
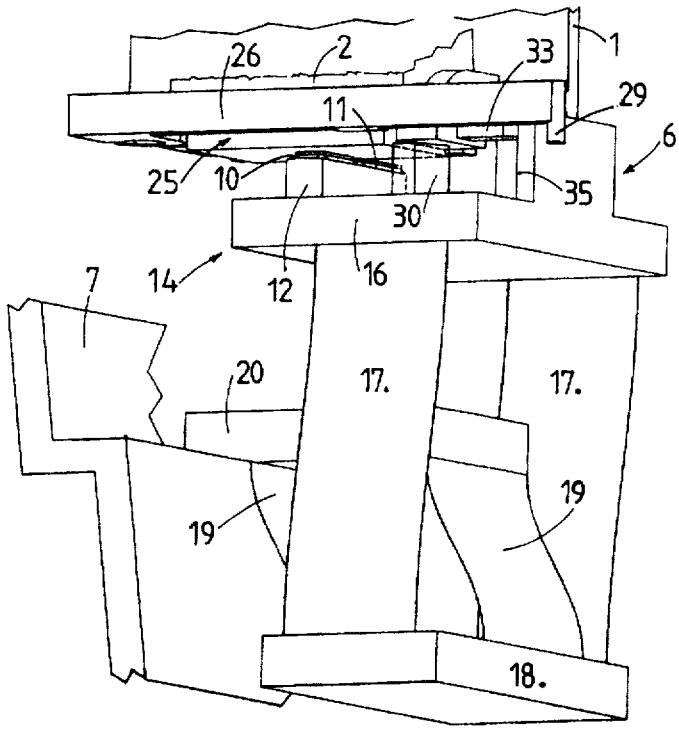

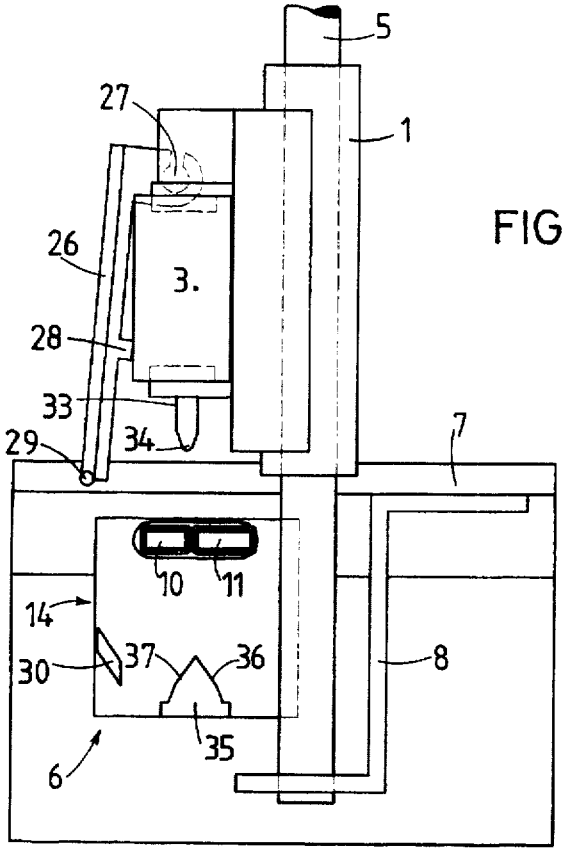
FIG. 4a
FIG. 4b
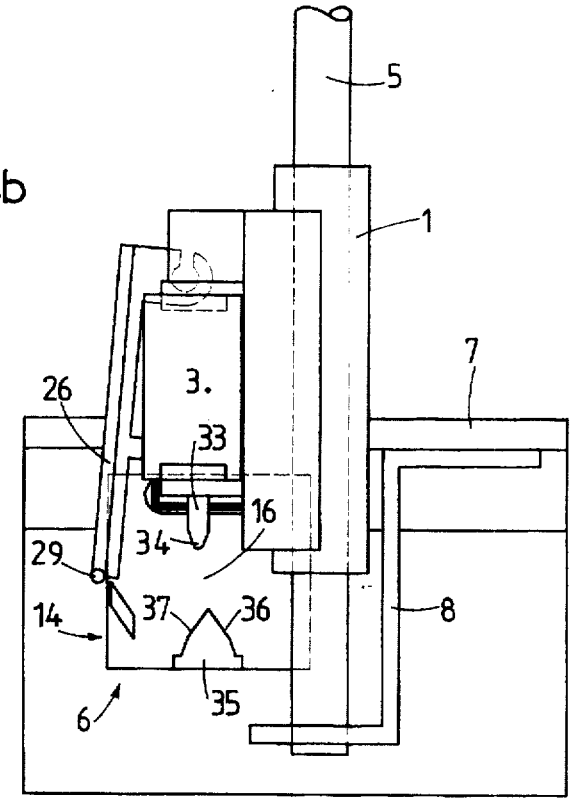

INKJET PRINTER

The present invention relates to an inkjet printer provided with a movable carriage arranged so as to receive al impression head interchangeable with at least one impression head of another type, the printer comprising a frame and a maintenance station providing at least two types of covers adapted to be applied on the impression head of the type for which they are adapted.

In inkjet printers, it is conventional to protect the ink ejection nozzles of the impression head, when they are located in a rest position for a long time between periods of printing, so as to avoid drying of the ink leading to blocking of the nozzles.

To this end, there is applied against the nozzle plate a cover which maintains a certain level of humidity.

The device which is the object of the invention is applied to a printer provided with an interchangeable impression head that can be plugged into the movable printing carriage.

Different types of heads can be plugged into the carriage, for example, a black ink head or a multi-color ink head.

To avoid soiling from the cover, of one head with ink from another head, for example, a colored head from a black head, respective covers are provided for each type of plug-in head.

U.S. Pat. No. 5,155,497 discloses a maintenance station for a printer of this type. The station comprises a support turning 180° about an axis parallel to the direction of displacement of the carriage and on which are mounted in opposed positions two covers by means of two slides displaceable longitudinally along this displacement direction of the movable carriage. After detection of the type of printing head mounted on the carriage, the turning support emplaces by rotation the slide and the cover corresponding to the head, the carriage then drives the slide longitudinally to apply the cover against the nozzle plate.

This maintenance station comprises a large number of pieces and is of complicated construction.

The object of the present invention is to overcome these drawbacks and it is characterized for this purpose by the fact that the maintenance station comprises a support for covers on which the covers are disposed side by side in a direction perpendicular to the direction of displacement of the carriage, the support being arranged so as to undergo, on the one hand, a first movement of translation relative to the frame along a direction parallel to said perpendicular direction to position one of the covers facing the printing head plugged into the carriage and, on the other hand, a second translation movement relative to the frame along a second direction perpendicular to said perpendicular direction forming such an angle with the direction of displacement of the carriage that the selected cover facing the head plugged into the carriage will be applied against this plugged-in head during said second translation movement.

In this way, there is obtained a very simple construction, less cumbersome, comprising a reduced number of pieces, and which is of reduced cost of production.

According to a preferred embodiment, the carriage is provided with a selection lever co-acting with the printing head plugged into the carriage to occupy distinct positions according to the type of plugged-in printing head, the selection lever being arranged so as to co-act with a member fixed to the support such that this latter will be displaced along the first translation movement to effect the selection of the cover to be applied.

Thanks to these characteristics, the control of the selection of the cover to be applied is effected in a reliable and simple manner.

According to a preferred embodiment, the support is connected to the frame by means of two pairs of flat springs perpendicular to each other and arranged in series, a first of these two pairs of flat springs permitting the first translation movement and the second pair controlling the second translation movement.

This arrangement insures reliable operation whilst providing a very much reduced number of components.

Other objects will become apparent from the characteristics set forth in the dependent claims and from the description hereafter of the invention in greater detail with the help of the drawings which show schematically by way of example an embodiment.

FIG. 1 is a schematic perspective view of a portion of a printer showing in particular the maintenance station.

Figure 2A:
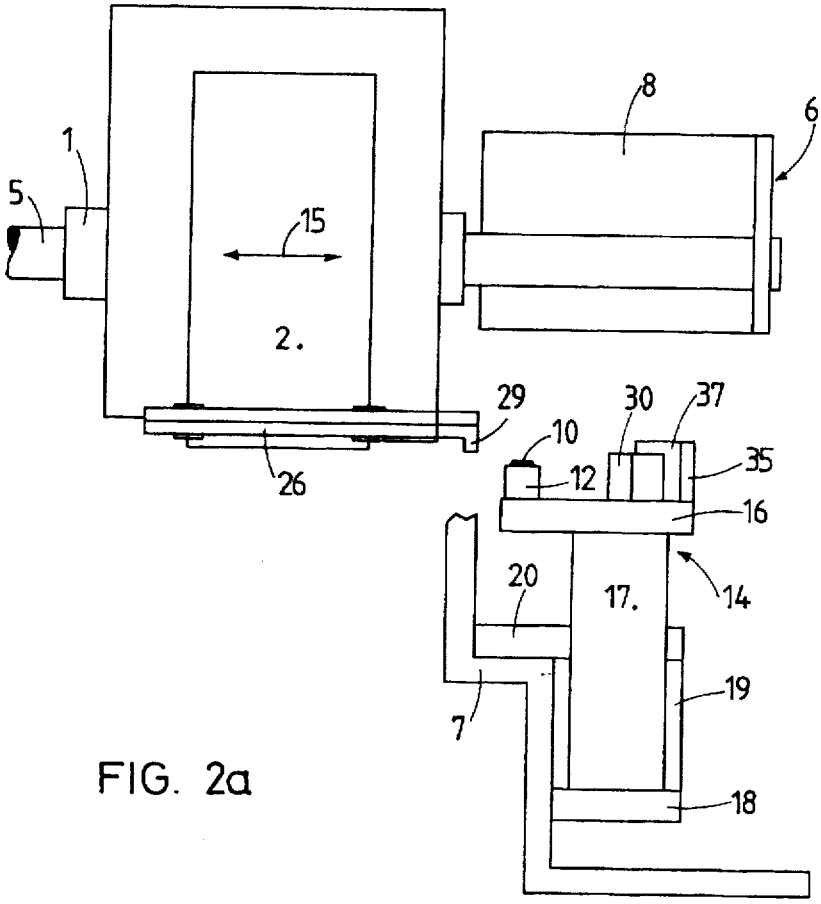
Figure 2B:
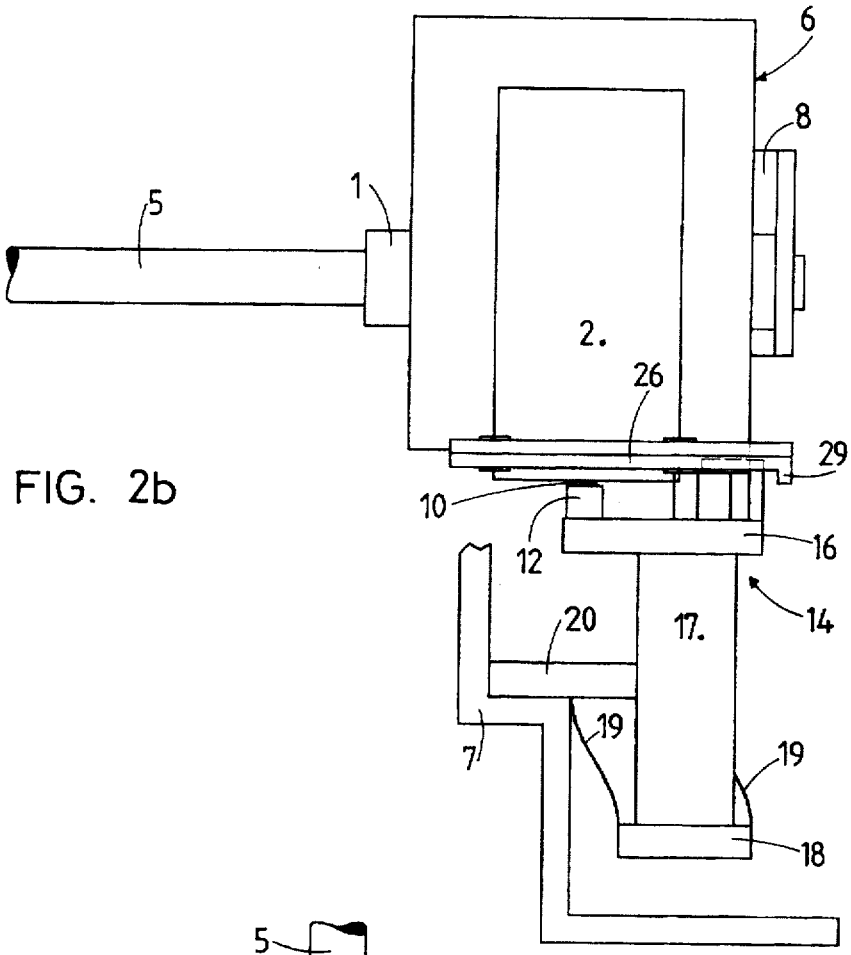

FIGS. 2*a* and 2*b* are front views showing the carriage (*a*) outside the maintenance station and (*b*) disposed in the maintenance station.

Figure 3A:
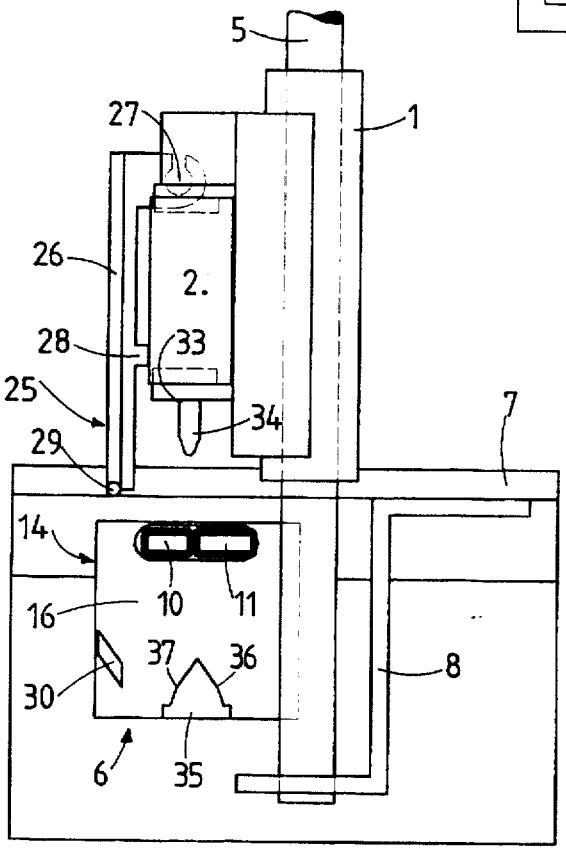
Figure 3B:
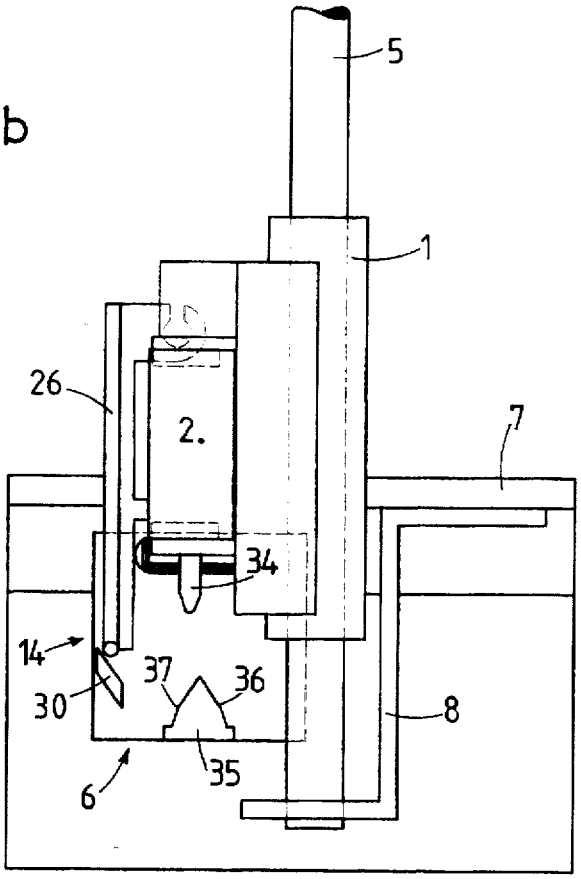
Figure 3C:
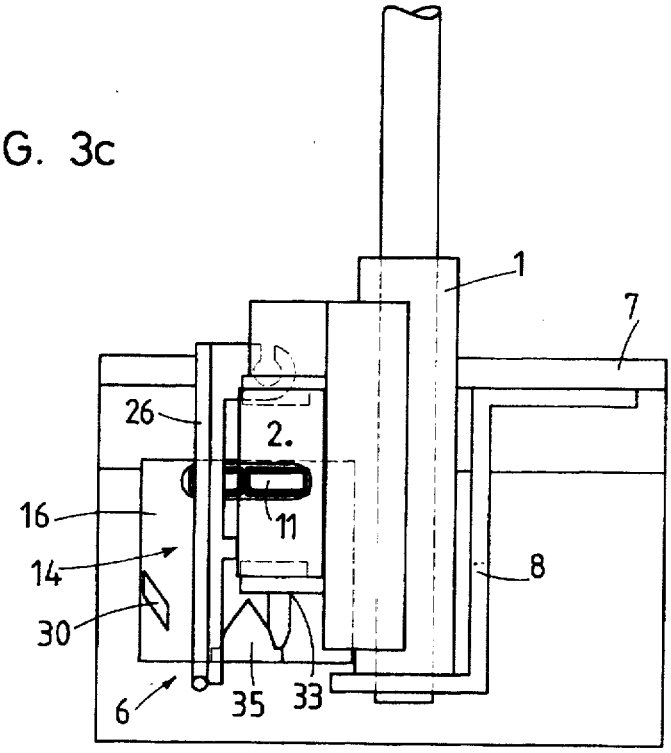

FIGS. 3*a*, 3*b* and 3*c* are plan views of the carriage with a first printing head (*a*) outside the maintenance station, (*b*) entering into the maintenance station during selection of the cover, and (*c*) stopped in the maintenance station.

Figure 4C:
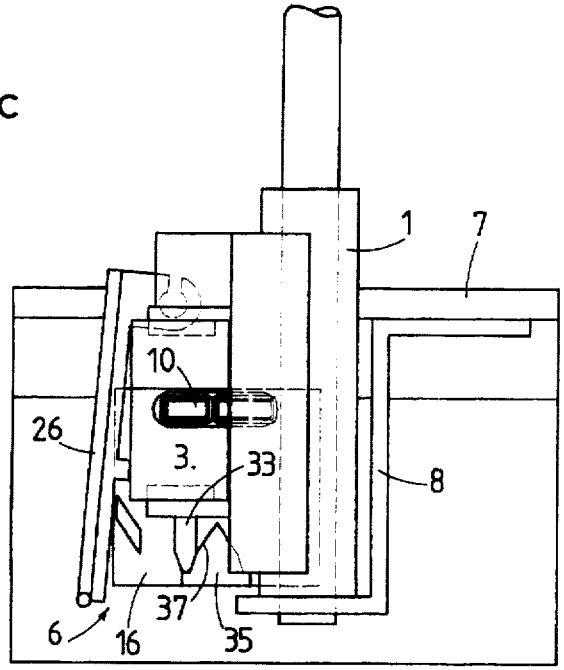

FIGS. 4*a*, 4*b* and 4*c* are also plan views of the carriage with a second printing head in three different positions relative to the maintenance station.

Figure 5A:
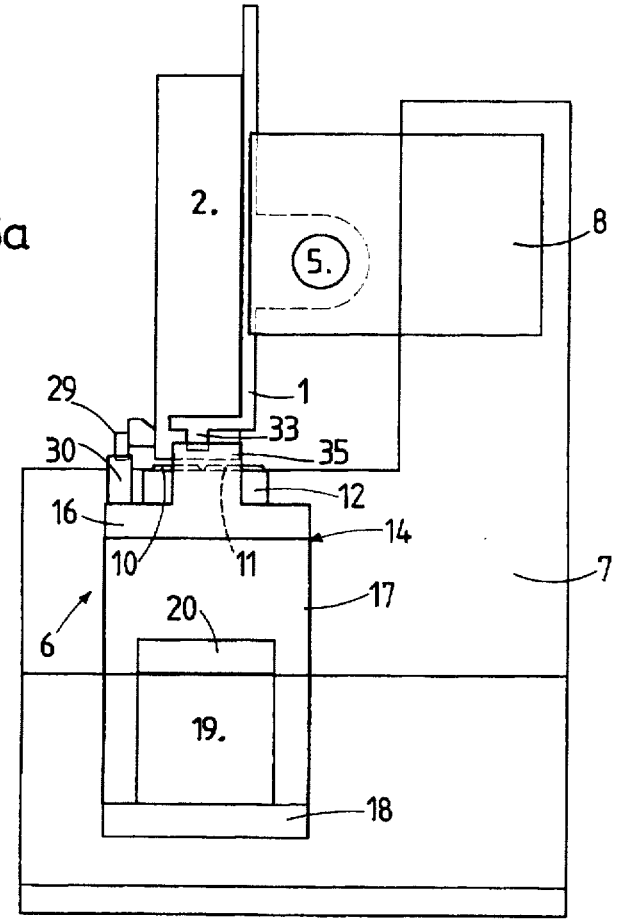
Figure 5C:
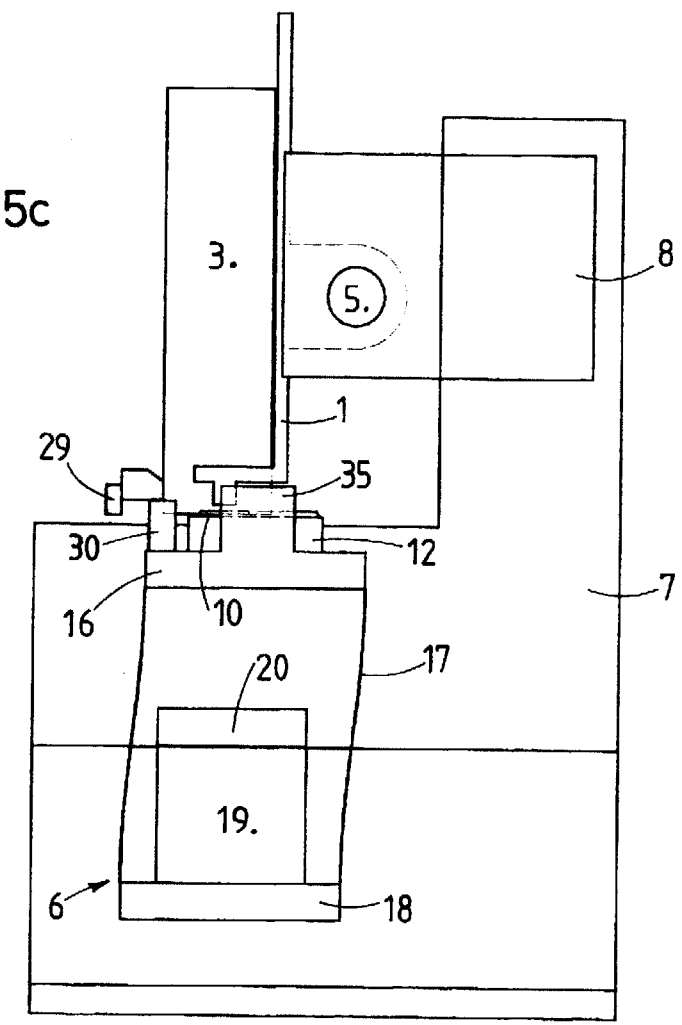
Figure 5B:
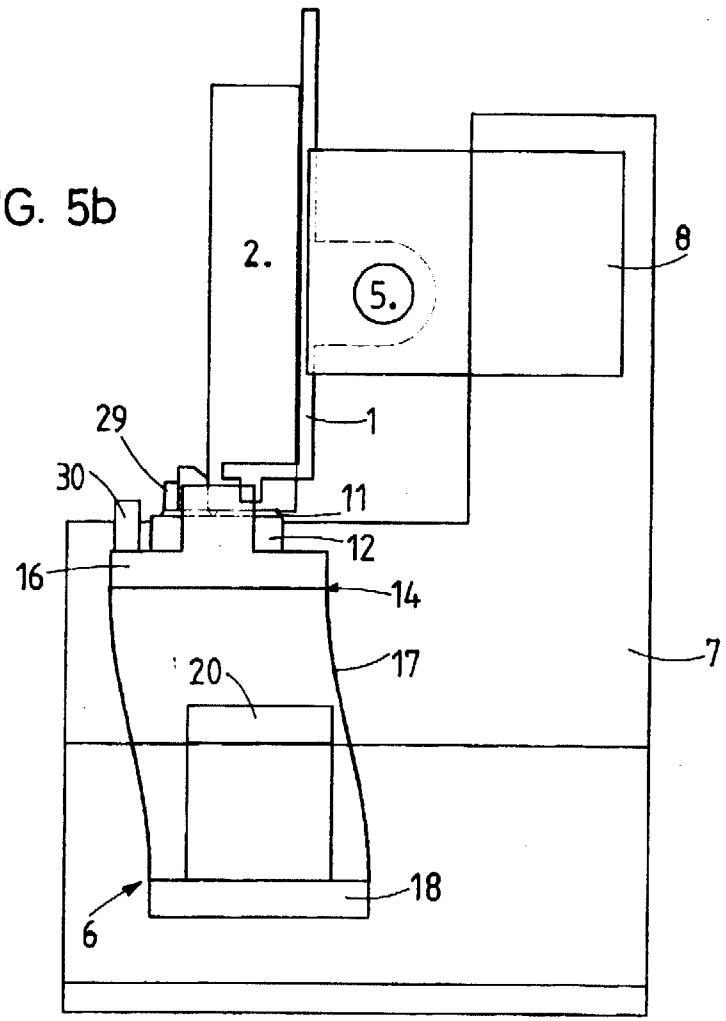

FIGS. 5*a*, 5*b* and 5*c* are side views showing the carriage in different positions relative to the maintenance station, in 5*a* the carriage is outside this latter, in 5*b* the carriage is within the station and provided with the first printing head, and in 5*c* it is within the station but provided with the second printing head.

The embodiment shown in FIGS. 1 through 5 comprises a carriage 1 carrying a printing head 2 of a first type plugged into this carriage and which can be exchanged with at least one printing head 3 of another type. The carriage 1 is mounted slidably on a shaft 5 fixed on the frame 7 of the printer thanks to a securement member 8 and is movable with back and forth movement across the document to print it.

The printer has a maintenance station 6 arranged laterally outside the printing region and which is adapted to prevent drying of the ink in the nozzles of the printing head and plugging of these nozzles. The maintenance station 6 comprises for this purpose covers 10 and 11 disposed side by side on cover carrier 12, itself mounted on the movable support 14 of complex structure. The two covers 10 and 11 are disposed side by side in a direction perpendicular to the direction 15 (FIG. 2*a*) of displacement of the carriage 1 and movable support 14 is so arranged as to effect a first translation movement relative to the frame 7 to dispose one or the other of the covers 10, 11 facing the printing head 2 or 3 plugged into the carriage.

This movable support 14 comprises a support plate 16 which carries the cover carrier 12 and which is connected to an intermediate plate 18 by a pair of flat springs 17, substantially parallel to the direction 15. The intermediate plate 18 is connected by a second pair of flat springs 19 perpendicular to the first pair, to a plate 20 secured to the frame 7 of the printer. These two pairs of flat springs 17 and 19 permit translatory movements of the support plate 16 in two directions perpendicular to each other.

To effect selection of the cover 10 or 11 which is to be placed facing the printing head 3 or 2, the maintenance station is provided with a selection and control mechanism 25, comprising a feeler lever 26 mounted pivotally at 27 on the carriage 1. This lever 26 has a feeling element 28 co-acting with the plugged-in printing head 2 or 3. As this head has a shape or an element of a shape different for each type of head, feeler lever 26 occupies an angular position which is different according to the printing head that is plugged in. Thus, the printing head 3 of FIG. 4*a* has a width greater than the printing head 2 of FIG. 2*a* and the lever is for this reason pivoted at an angle of about 25° on the carriage.

The mechanism 25 also comprises a ramp 30 fixed to the plate support 16 and adapted to co-act with a finger 29 provided at the end of the feeler lever 26. Thus, in the case of the printing head 2 of FIGS. 3*a* to 3*c*, this finger 27 enters into contact with the ramp 30 to displace the plate support 16 to the left in FIG. 3*b*. Contrariwise, the finger 29 passes beside the ramp 30 when the wider printing head 3 is plugged into the carriage 1 (FIGS. 4*a* to 4*c*).

The mechanism 25 has moreover a pusher 33 in the form of a tooth 34 secured to the carriage 1 and which is adapted to co-act with a projection 35 in the form of a cam secured to the plate support 16. This projection 35 has two sliding flanks 36 and 37 separated by a point on which the tooth 34 bears when the cartilage 1 is displaced in the maintenance station 6. Thus, the tooth 34 faces the flank 37 when the finger 29 passes beside the ramp 30 (FIG. 4*b*) and co-acts with this flank 37 to push the plate support 13 to the right in FIG. 4*c* to position the cover 10 facing the printing head 3.

On the other hand, when the finger 29 co-acting with the ramp 30 effects a selection, the tooth 34 enters into contact with the flank 36 and displaces the plate support 13 to the left in FIG. 3*c* to position the cover 11 facing the printing head 2.

After selection of the cover 10 or 11 has been effected by bending of the flat springs 17, the carriage 1 continues its course pressing the plate support 16 by means of pusher 13 and projection 35, the flat springs 19 are then deformed as is shown in FIG. 2*b*. The distance separating the plates 18 and 20 is thus shortened and the plate support 16 and the covers 10, 11 undergo an oblique displacement upwardly in the direction of the printing head 2 or 3 to urge one or the other of the covers against the plugged-in printing head.

Thus, the complex support 14 permits accomplishing the displacement of the covers for their selection and their application against the printing head by a very simple construction requiring no particular drive, other than movement of the carriage. During plugging in of the printing head on the carriage 1, the feeler lever 36 is brought to a predetermined angular position to co-act or not with the ramp 30 on the plate support 16 so as to effect the selection of the suitable cover which is placed facing the printing head. The lateral translation of the plate support is then effected by sliding of the tooth 34 along one of the two flanks of the projection 35. After this lateral translation, the carriage again undergoes the application of the selected cover against the printing head to then be immobilized in the maintenance station with the nozzles covered by the appropriate cover. During printing, the plate support 16 returns under the resilient effect of the flat springs 17 and 19 to its initial position shown in FIGS. 2*a*, 3*a*, 4*a* and 5*a*.

Of course, the embodiment described above is not limiting and can be the subject of various desired modifications within the scope defined by claim 1. In particular, the feeler lever 36 could be replaced by a projecting portion of the printing head acting directly on the ramp 30. The displacement of the plate support of the covers could also be accomplished by direct action on the projection 35 in the form of a cam without preselection by the ramp and with or without the presence of a feeler lever 26.

The two pairs of flat springs 17 and 19 could be replaced by any other mechanism permitting effectuating the lateral and application movements of the covers, for example, by means of levers urged by springs toward a rest position.

There could also be provided, using the same principle, a modification permitting three or more different types of printing heads.

In this case, the support plate 16 could be a central cover and two lateral covers, for example. The direction and magnitude of the perpendicular translatory movement would then be defined by the type of printing head plugged in. One or several covers could be connected by the flexible tube to a suction pump permitting triggering the printing head or provided with a pad absorbing the ink. The maintenance station could also be provided with one or several strips adapted to drive the frontal portion of the printing heads. These strips could be mounted retractably or not on the movable support or on the frame.

What is claimed is:

1. In an inkjet printer comprising a movable carriage (1) having a printing head (2) interchangeable with at least one printing head (3) of another type, the printer comprising a frame (7) and a maintenance station (6) having at least two types of covers (10, 11) adapted to be applied to the printing head (2, 3) of the type to which they are adapted; the improvement wherein the maintenance station (6) comprises a cover support (14) on which the covers (10, 11) are disposed side by side in a direction perpendicular to the direction of movement (15) of the carriage, said support (14) being arranged so as to carry out a first translatory movement relative to the frame (7) in a direction parallel to said perpendicular direction to position one of the covers (10, 11) facing the printing head (2, 3) plugged into the carriage (1), and a second translatory movement relative to the frame in a second direction perpendicular to said perpendicular direction making such an angle with the direction of movement (15) of the carriage that the selected cover (10, 11) facing the plugged-in head (2, 3) on the carriage (1) will be applied against this plugged-in head during said second translatory movement.

2. Printer according to claim 1, wherein the printing heads (2, 3) differ from each other by at least one distinctive element of shape adapted to control one of the direction and the length of the first translatory movement of the support (14).

3. Printer according to claim 2, wherein the carriage (1) has a selection lever (26) co-acting with the printing head plugged into the carriage to occupy different positions according to the type of plugged-in printing head, the selection lever (26) being arranged so as to co-act with a member (30) fixed to the support (14) such that said support (14) will be displaced according to the first translatory movement to effect the selection of the cover (10, 11) to be used.

4. Printer according to claim 2, wherein the carriage (1) comprises a pusher (33) arranged so as to co-act with a cam (35) secured to the support (14) during displacement of the carriage to effect said first translatory movement according to one or the other of the two opposite directions as a function of the selection that was made.

5. Printer according to claim 1, wherein the carriage (1) comprises a portion (33) adapted to co-act with a corresponding portion (35) of the support (14) to effect said second translatory movement of the support (14).

6. Printer according to claim 1, wherein the support (14) is connected to the frame by means of two pairs of flat springs (17, 19) perpendicular to each other and disposed in series, a first one (17) of the two pairs of flat springs permitting said first translatory movement and the second pair (19) controlling said second translatory movement.

7. Printer according to claim 6, wherein said second direction makes an angle with the direction of movement of the carriage and is controlled by the arrangement of the second pair (19) of flat springs relative to the frame.

* * * * *